US005207316A

United States Patent [19]

Sakamoto

[11] Patent Number: 5,207,316

[45] Date of Patent: May 4, 1993

[54] LIMIT SWITCH

[75] Inventor: Kunio Sakamoto, Kurayoshi, Japan

[73] Assignee: Omron Corporation, Kyoto, Japan

[21] Appl. No.: 785,573

[22] Filed: Oct. 30, 1991

[30] Foreign Application Priority Data

Nov. 1, 1990 [JP] Japan ..... 2-297550

[51] Int. Cl.[5] ..... H01H 3/16

[52] U.S. Cl. ..... 200/47; 200/573; 74/107; 74/569

[58] Field of Search ..... 200/47, 573, 574, 567, 200/336; 74/107 X, 567, 569 X; 267/750

[56] References Cited

U.S. PATENT DOCUMENTS

| | | | |
|---|---|---|---|
| 3,512,422 | 5/1970 | Aslan | 200/47 X |
| 3,740,504 | 6/1973 | Hipple | 200/47 |
| 3,749,860 | 7/1973 | Crepeau | 200/47 |
| 3,931,484 | 1/1976 | Chace et al. | 200/47 |
| 3,959,614 | 5/1976 | Graninger | 200/47 |
| 4,406,933 | 9/1983 | Boozer | 200/47 |
| 4,847,453 | 7/1989 | Newell et al. | 200/47 |

FOREIGN PATENT DOCUMENTS 57-84524 5/1982 Japan .

*Primary Examiner*—Ernest G. Cusick
*Assistant Examiner*—Glenn T. Barnett
*Attorney, Agent, or Firm*—Fish & Richardson

[57] ABSTRACT

A limit switch is disclosed which comprises an operating lever, a rotary shaft which is driven by the operating lever, a first cam and a second cam as mounted on the rotary shaft for transformation of rotary motion into linear motion, a return spring for applying a returning force to the operating lever through the rotary shaft, a plunger operatively associated with the cams for turning a basic switch ON or OFF and a plunger holder for holding the plunger axially movable but not rotatable. The plunger having a plurality of integral projections corresponding to cam projections of the respective cams and disposed between the cams. The plunger is rotatable about its axis through the plunger holder to switch the ON-OFF mode of the basic switch.

1 Claim, 6 Drawing Sheets

LIMIT SWITCH

FIELD OF THE INVENTION

The present invention relates to a limit switch for various production equipment, industrial robots and so on.

BACKGROUND OF THE INVENTION

The limit switch in general comprises a switch case housing, a basic switch mechanism having a push-in rod actuator, a head mounted on the switch case and housing, among others, a cam means for transforming a rotary motion into a linear motion, and an operating lever privotally connected to the head. Here, as the operating lever is angularly displaced by an object to be detected, such as a work, to an operating position against the biasing force of a return spring means, the angular displacement of the operating lever is transformed into a linear motion to drive a plunger supported by the switch case or head and thereby push in the rod actuator of the basic switch.

FIG. 7 is a partially exploded side elevation view showing the main part of a conventional limit switch.

As illustrated, a head 3 secured to the top of a switch case housing a basic switch mechanism has a rotary shaft 4 supported by journal bearing means 5,6 and an operating lever 7 is secured to an outer end 4*a* of the rotary shaft 4. Secured to the rotary shaft 4 are a first cam 12 and a second cam 13 in juxtaposition and a cam projection 12*a* of the first cam 12 is set for rotation, for example in the direction of arrowmark a in FIG. 8, while a cam projection 13*a* of the second cam 13 is set for rotation, for example in the direction of arrowmark b in FIG. 8. Installed through a spring holder 11 on the flat peripheral surface of the rotary shaft 4 is a spring means 14 for applying a returning force to the operating lever 7 via the rotary shaft 4.

At the bottom of the head 3, a plunger holder 15 is rotatably supported by a cover plate 10, with an annular retaining spring 8 having tongue members 8*a*, shown in FIG. 9, being interposed between the plunger holder 15 and the cover plate 10. A plunger 16 associated with the first and second cams 12,13 is pivotally supported by the plunger holder 15. A pair of steel balls 17,18 are interposed between the plunger 16 and the first and second cams 12,13 in such a manner that the balls are free to roll. In addition, the steel balls 17,18 are concentrically accommodated in a pair of holding orifices 21*a*, 21*b*, respectively, of a steel ball holder 21 secured to the bottom wall of the head 3, while a top wall 16*g* of the plunger 16 is formed with a cutout 16*f* for accepting either one of the steel balls 17,18 (FIG. 10).

Now, as the rotary shaft 4 is rotated in the direction of arrowmark a in FIG. 8 in response to rotation of the operating lever 7, the cams 12,13 overcome the biasing force of the spring means 14 to turn until the cam projection 12*a* is abutted against the steel ball 17, thus pushing the plunger 16 axially to turn the basic switch, not shown, ON, for instance.

On the other hand, when the rotary shaft 4 is rotated in the direction of arrowmark b in response to rotation of the operating lever 7, the other cam projection 13*a* is not abutted against the steel ball 18 because this steel ball 18 has been fitted into the cutout 16*f*, with the result that the plunger 16 is not axially driven and, hence, the basic switch is retained in OFF position.

Thus, the plunger 16 is axially driven to turn the basic switch ON only when the operating lever 7 causes the rotary shaft 4 to turn in the direction of arrow-mark a. The relative position of cam projections 12*a*,13*a* of the cams 12,13, the steel balls 17,18 and the cutout 16*f* of the plunger 16 in the above situation is diagrammatically illustrated in FIG. 11 (A).

When the plunger 16 is swung about its axis in the direction of arrowmark c or d into the position illustrated in FIG. 11 (B), the reverse of the above situation holds. Thus, the plunger 16 is driven axially to turn the basic switch ON only when the operating lever 7 is rotated in the direction of arrowmark b.

Furthermore, when the plunger 16 is set in the position indicated in FIG. 11 (C), the following relation holds. Thus, the plunger 16 can be axially driven to turn the switch ON by rotating the operating lever 7 in whichever of the directions shown by arrow-marks a and b.

In the above arrangement, a variety of axial drives of the plunger 16 can be achieved by changing relative position of the cutout 16*f* of plunger 16 with respect to the cams 12,13 but in order to achieve such results, the steel balls 17,18 and steel ball holder 21 are essential and this means not only a large number of parts required but also a complication of assembling work.

SUMMARY OF THE INVENTION

The object of the present invention is to provide a limit switch which requires only a reduced number of parts for achieving a multiplicity of plunger drives and is easy to assemble.

The limit switch of the present invention comprises an operating lever, a rotary shaft which is driven by the operating lever, a first cam and a second cam as mounted on the rotary shaft for transformation of rotary motion into linear motion, a return spring means for applying a returning force to the operating lever through the rotary shaft, a plunger operatively associated with the cams for turning a basic switch ON or OFF and a plunger holder for holding the plunger axially movable but not rotatable, said plunger having a plurality of integral projections corresponding to cam projections of the respective cams and disposed between the cams.

In the above arrangement, by rotating the plunger about its axis through the plunger holder to alter the relative position of the plunger with respect to the respective cams, a variety of axial drives of the plunger according to the operating direction of the operating lever can be achieved to thereby alter the ON-OFF mode of the basic switch.

Furthermore, because the plunger has a plurality of integral projections, the steel balls and steel ball holder mentioned hereinbefore are no longer required so that the number of parts required is reduced and the assembling work is facilitated.

DETAILED DESCRIPTION OF THE PREFERRED EMBODIMENT

The present invention is now described in detail with reference to the preferred embodiments illustrated in the accompanying drawings.

Figure 1:
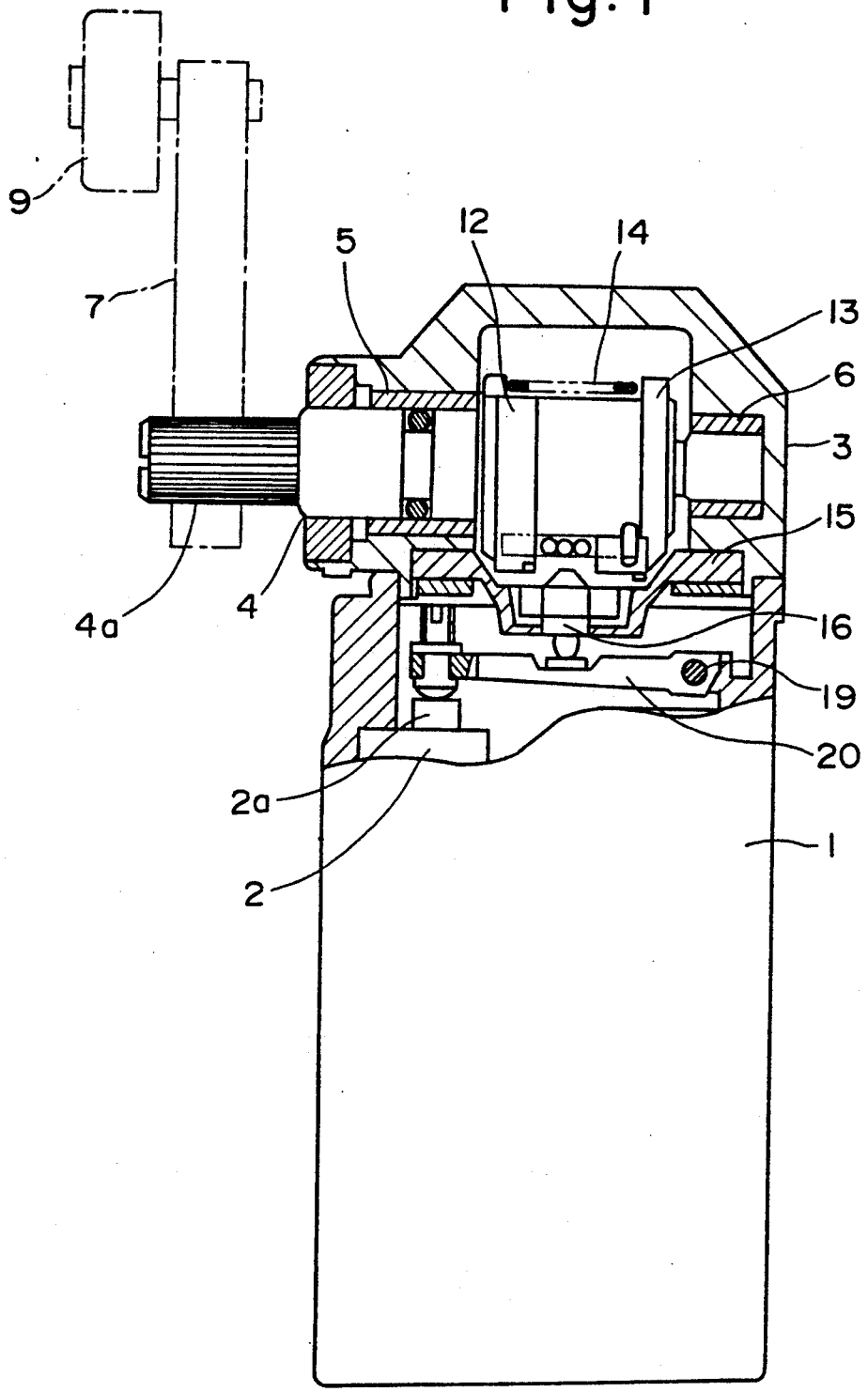
FIG. 1 is a partially exploded side elevation view showing a limit switch embodying the principles of the invention.
Figure 2:
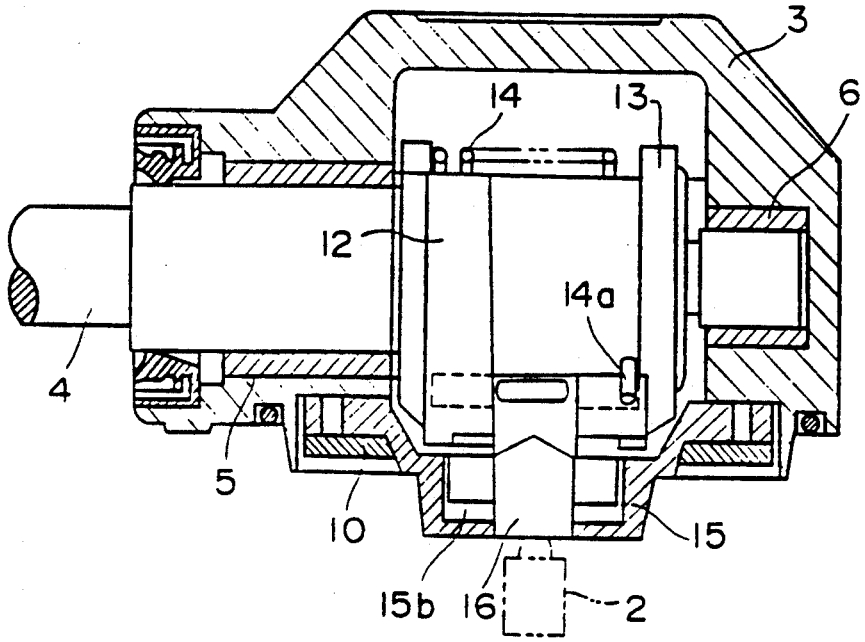
FIG. 2 is a longitudinal section view showing the main part of the limit switch on exaggerated scale.

Referring to FIGS. 1 and 2, a switch case 1 houses a basic switch 2 and a switch head 3 is securely mounted on top of the switch case 1. The reference numeral 4 indicates a rotary shaft which is supported by the head 3 through journal bearings 5,6, with an operating lever 7 being secured to its outer end 4*a*. Rotatably attached to the forward end of the operating lever 7 is a roller 9 which is abutted against an object to be detected.

Figure 3:
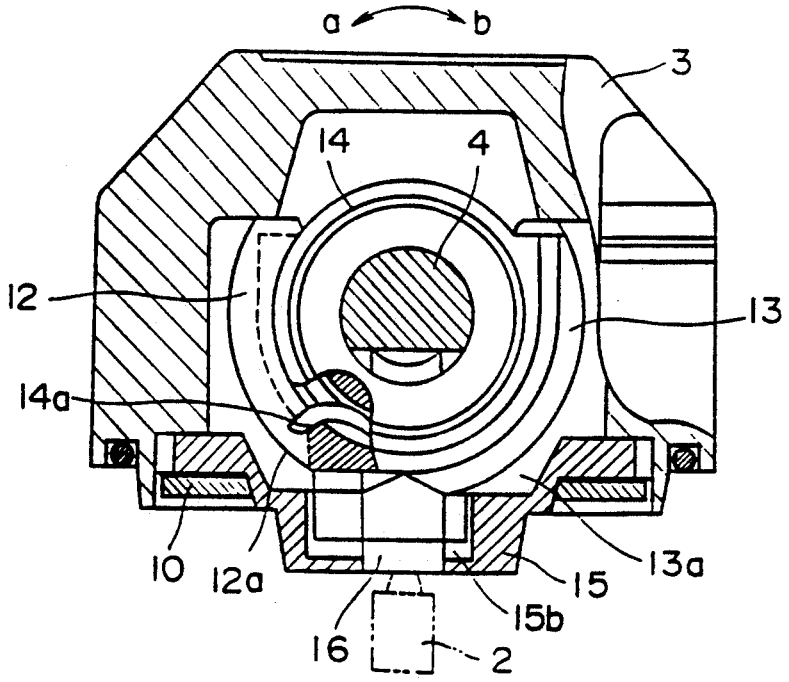
FIG. 3 is a cross section view of FIG. 2.

Secured in juxtaposition to the rotary shaft 4 are a first and a second cam 12,13 and a cam projection 12*a* of the first cam 12 is set for rotation, for example in the direction of arrowmark a in FIG. 3, while a cam projection 13*a* of said second cam 13 is set for rotation, for example in the direction of arrowmark b in FIG. 3. A return coil spring 14 is installed over the peripheral surfaces of the first and second cams 12,13 for applying a returning force to the operating lever 7 through these cams 12,13, with one end (not shown) thereof being secured internally of the head 3, while the other end 14*a* engages the cam 13. A plunger holder 15 is rotatably supported by a cover plate 10 secured to the bottom wall of the head 3.

Figure 4:
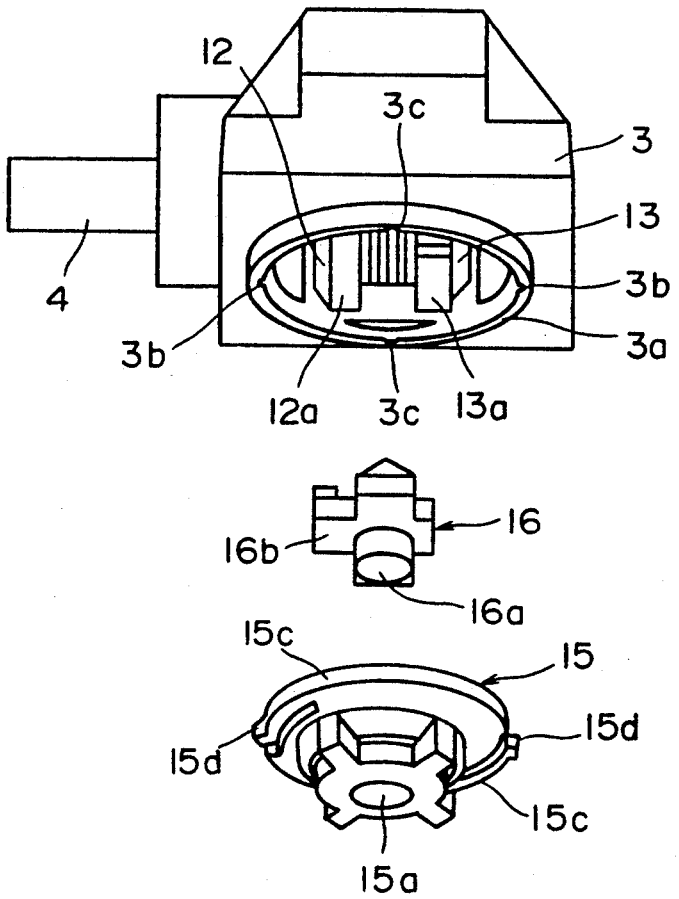
FIGS. 4 and 5 each is a perspective view showing the main part of the limit switch as disassembled.

Thus, as shown in FIG. 4, the plunger holder 15 has an axial hole 15*a* in which a shaft portion 16*a* of a plunger 16 associated with cam projections 12*a*,13*a* of the first and second cams 12,13 is installed so as to be axially movable and a recess 15*b* in which an approximately cruciform base 16*b* of said plunger 16 is unrotatably fitted (FIGS. 2 and 3). In addition, the holder 15 is provided with a circumferentially extending engaging member 15*c*, with its forward projection 15*d* being fitted into an annular boss 3*a* at the bottom wall of the head 3 and disengageably held by engaging grooves 3*b*,3*c* on its inner circumferential surface.

Figure 5:
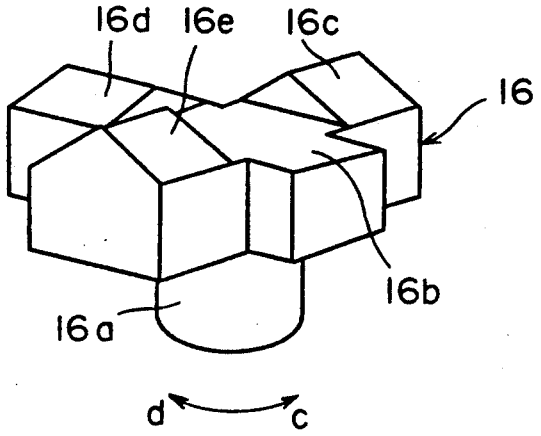

The base 16*b* of the plunger 16 has projections 16*c*, 16*d* and 16*e* extending radially on three mutually adjoining sides as shown in FIG. 5. Disposed within the switch case 1 between said plunger 16 and said basic switch 2 is a driving lever 20 supported by a support shaft 19.

The action of the above mechanism is now explained.

As the operating lever 7 is operated to turn the rotary shaft 4 from its neutral position in the direction of arrowmark a in FIG. 3, for instance, the first and second cams 12,13 are caused to turn against the biasing force of the return coil spring 14 together with the rotary shaft 4. In response to this rotation, a biasing force in the direction b for returning the rotary shaft 4 is accumulated in the return coil spring 14, while the cam projection 12*a* of the first cam 12 drives the plunger 16 axially through the projection 16*d* of the plunger 16 to thereby press an actuating rod 2*a* to turn the basic switch 2 ON. As the rotating force on the operating lever 7 is released, the accumulated biasing force in the return coil spring 14 causes the operating lever 7 to return to the neutral position.

On the other hand, when the operating lever 7 is actuated so as to rotate the rotary shaft 4 in the direction of arrowmark b, the cam projection 13*a* of the second cam 13 is not abutted against any of the projections 16*c* through 16*e* and, hence, the plunger 16 is not pressed by the cam 13, with the result that the plunger 16 is not axially driven, thus retaining the basic switch 2 in OFF position.

Therefore, when the plunger 16 is disposed as shown with respect to the cams 12,13, the plunger 16 can be axially driven to turn the switch 2 ON only when the operating lever 7 is actuated so as to rotate the rotary shaft 4 in the direction of arrowmark a. In this situation, the positional relationship of the cam projections 12*a*,13*a* of the first and second cams 12,13 with respect to the projections 16*c* through 17*e* of the plunger 16 is as shown diagrammatically in FIG. 6 (A), and the action here is similar to that in the condition illustrated in FIG. 11 (A) for the prior art.

Figure 6:
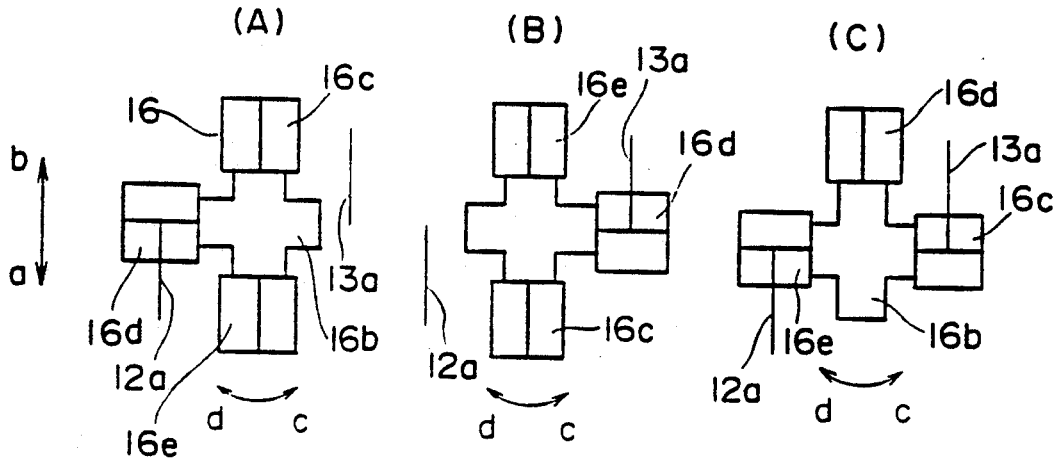
FIG. 6 (A) through (C) are diagrammatic views explaining the action of the same limit switch.

When the plunger 16 is rotated about its axis in the direction of arrowmark c or d to select the setting illustrated in FIG. 6 (B), for instance, the reverse holds true. Thus, the plunger 16 is axially driven to turn the switch 2 ON only when the operating lever 7 is turned in the direction of arrowmark b, and the action here is similar to that in the condition illustrated in FIG. 11 (B) for the prior art.

Figure 11:
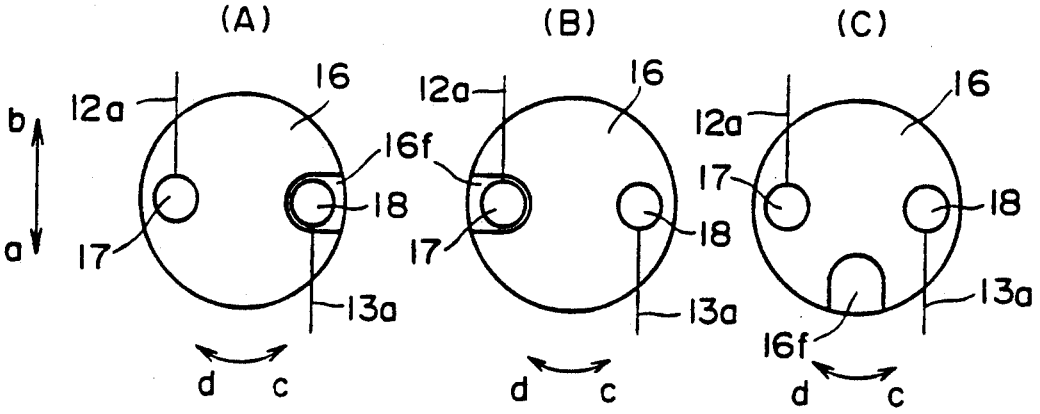
Fig. 11 PRIOR ART
FIG. 11 (A) through (C) are diagrammatic views explaining the main part of the same limit switch.
Figure 7:
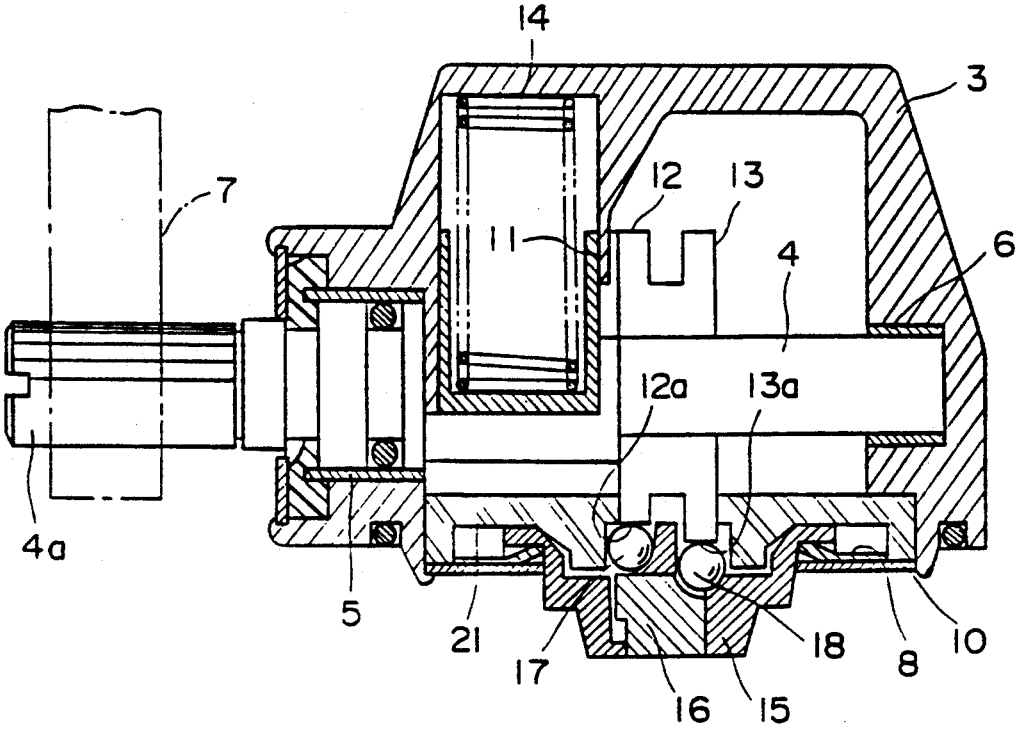
Fig. 7 PRIOR ART
FIG. 7 is a longitudinal section view showing the prior art limit switch on exaggerated scale.
Figure 8:
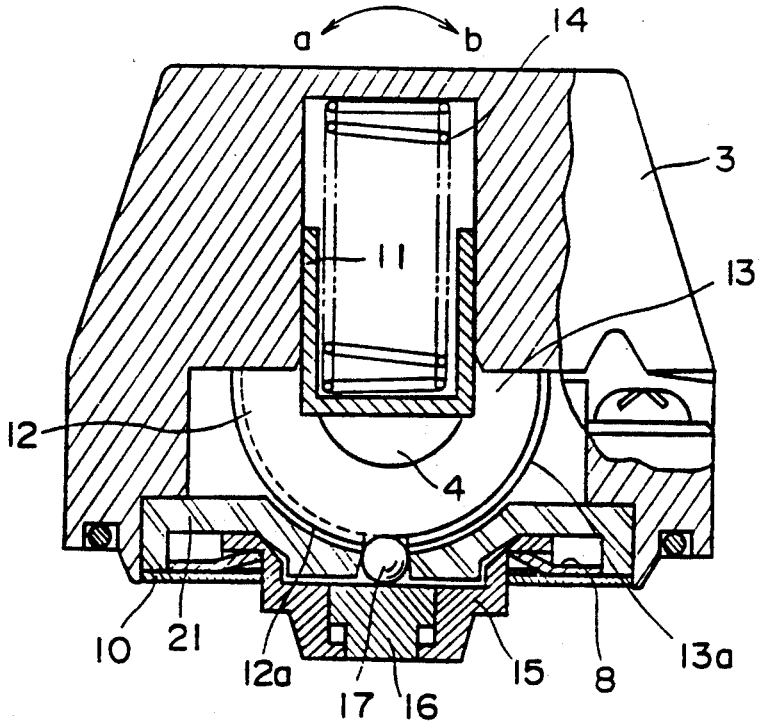
Fig. 8 PRIOR ART
FIG. 8 is a cross-section view of FIG. 7.
Figure 9:
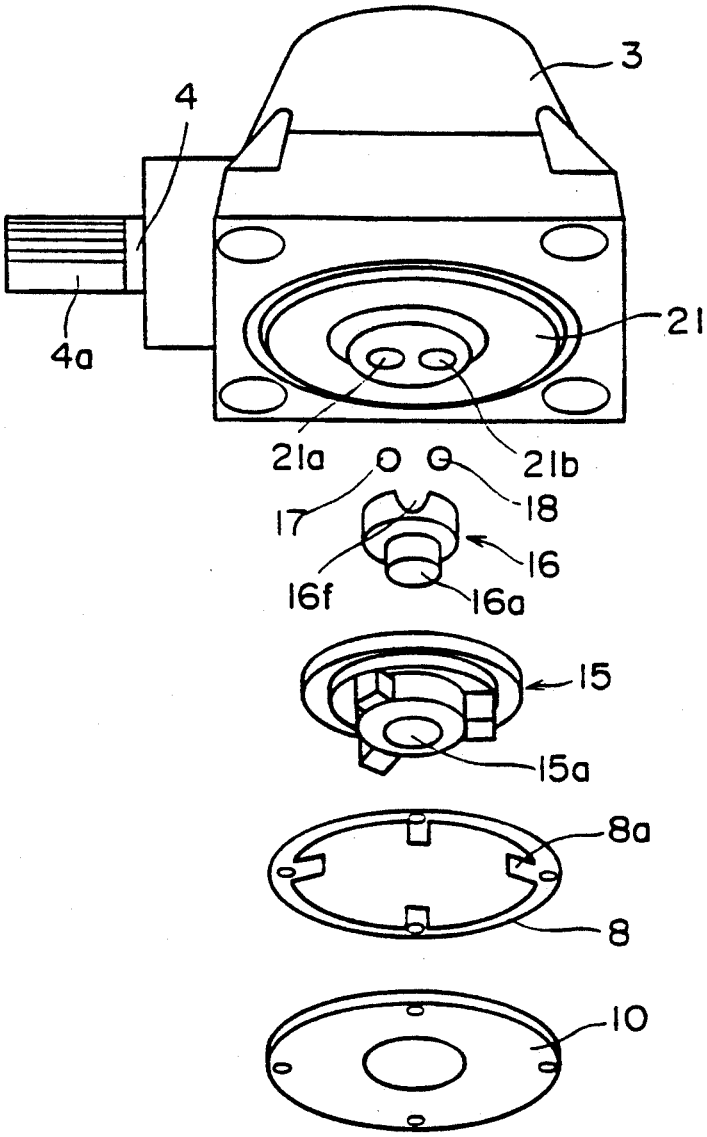
Fig.9 PRIOR ART
FIGS. 9 and 10 each is a perspective view showing the main part of the same limit switch as disassembled.
Figure 10:
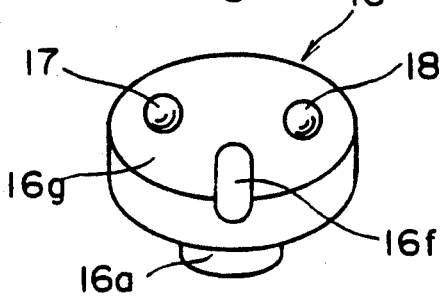
Fig.10 PRIOR ART

Furthermore, when the plunger 16 is set as illustrated in FIG. 6 (C), the plunger 16 is axially driven to turn the switch 2 ON when the operating lever 7 is turned in whichever of the directions indicated by arrowmarks a and b, and the action here is similar to that in the situation illustrated in FIG. 11 (C) for the prior art.

As apparent from the above description, a variety of axial drives of the plunger 16 can be achieved according to the operating direction of the operating lever 7 by changing the relative position of the plunger 16 with respect to the cams 12,13. Moreover, since the base 16*b* of said plunger 16 has roof-shaped projections 16*c*, 16*d* and 16*e* extending radially on three mutually adjoining sides as illustrated in FIG. 5, it is no longer necessary to provide the steel balls 17,18 and steel ball holder 21 required of the prior art, thus making it possible to cut the number of parts required as well as facilitate the assembling work.

Referring to the change of the relative position of the plunger 16 with respect to the cams 12,13, inasmuch as the holder 15 has a circumferentially extending engaging member 15*c* with its forward engaging projection 15*d* being fitted in the annular boss 3*a* of the head 3 and disengageably engaged by the engaging grooves 3*b*,3*c* on the inner circumferential surface thereof, the disposing position of the plunger 16 due to rotation of the holder 15 is limited and the positioning can be sensed from the feeling of engagement or disengagement between the engaging projection 15*d* and the engaging grooves 3*b*,3*c*.

The above description and the accompanying drawings are merely illustrative of a few modes of application of the principles of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

What is claimed is:

1. A limit switch having a plurality of modes of operation, comprising a switch head having an annular boss with grooves disposed on an inner circumferential surface of said annular boss, an operating lever, a rotary shaft extending through said switch head and being connected to and driven by said operating lever, a first cam and a second cam, each cam having a cam projection, said cams being mounted on said rotary shaft with said switch head for transforming rotary motion into linear motion for acutating a basic switch located within a switch case, wherein said switch head is mounted to said switch case, a return spring means position within said switch head and disposed around a portion of said rotary shaft for applying a returning force to said operating lever through said rotary shaft, a plunger disposed in said switch head and operatively associated with said cams for actuating said basic switch positioned within said switch case and a plunger holder for holding said plunger such that said plunger is capable of linear movement for actuating said basic switch, said plunger having a plurality of integral projections aligned with said cam projections on said cams, said plunger holder being arranged in said switch head such that it is capable of rotation about an axis such that said plunger can be rotated about the axis thereby changing the alignment of said plurality of integral projections with said cam projections thereby changing the mode of operation of said limit switch said plunger holder including a circumferentially extending engaging member having a forward projection, said forward projection being disposed in said annular boss for selectively engaging said grooves for controlling rotation of the holder.

* * * * *